United States Patent [19]

Smith et al.

[11] 4,220,092

[45] Sep. 2, 1980

[54] LEAF-SPRING COLOR-DISSEMINATING PROJECTILE FOR TRAINING CARTRIDGE

[75] Inventors: Robert C. Smith, Succasunna; John H. Webb, Hopatcong, both of N.J.

[73] Assignee: The United States of America as represented by the Secretary of the Army, Washington, D.C.

[21] Appl. No.: 935,838

[22] Filed: Aug. 22, 1978

[51] Int. Cl.[3] ..... F42B 11/18

[52] U.S. Cl. ..... 102/92.7; 102/41; 102/66; 102/90

[58] Field of Search ..... 102/6, 60, 65, 66, 87, 102/90, 41, 92.7

[56] References Cited

U.S. PATENT DOCUMENTS

| | | | |
|---|---|---|---|
| 3,983,817 | 10/1976 | Tucker | 102/41 |
| 4,128,059 | 12/1978 | Black | 102/92.7 |

*Primary Examiner*—Harold J. Tudor

*Attorney, Agent, or Firm*—Nathan Edelberg; Robert P. Gibson; A. Victor Erkkila

[57] ABSTRACT

A training cartridge projectile includes a cylindrical base member, a cup-shaped plastic ogive member having its open end attached to the front end of the base member to form a color cavity and having an annular weakening groove; at least one leaf spring resiliently interposed between the ogive member and the front end of the base member; and a mass of aerosol-producing color material in the color cavity. On impact with a target, the ogive member breaks at the weak area, releasing the leaf spring, which snaps back to its original shape and thereby disseminates the color material into the air, thus producing an easily visible aerosol color signal in the region of impact.

4 Claims, 2 Drawing Figures

LEAF-SPRING COLOR-DISSEMINATING PROJECTILE FOR TRAINING CARTRIDGE

GOVERNMENTAL INTEREST

The invention described herein may be manufactured, used or licensed by or for the Government for governmental purposes without the payment to us of any royalties thereon.

BACKGROUND AND SUMMARY OF THE INVENTION

The present invention relates to improved training or practice cartridges, and particularly to an improved color-disseminating projectile for such cartridges.

A need exists for a low-cost 40mm training cartridge for use in the M79/M203 grenade launchers and/or the XM174 automatic grenade launcher. The training cartridge must produce a color signal that is visible to the unaided eye under various terrain conditions at all usable ranges. These training cartridges are consumed in considerable quantities in training of troops, which emphasizes the need for minimum cost.

The present invention evolved as part of an overall program to develop a new and improved cartridge that would satisfy the functional requirements of the current 40mm, M407, practice cartridge at a substantially lower cost. The projectile of the M407 cartridge comprises a cavity filled with a finely-divided dye material and explosive means for disseminating the dye into the air at impact to produce a visible aerosol color signal. An object of the present invention was to substitute lower-cost non-explosive means for disseminating the dye material.

In accordance with the invention, a training cartridge projectile is provided, which comprises a generally cylindrical base member, a cup-shaped ogive member of frangible material, e.g. plastic, closed at one end and open at the other end, having its open end attached to the front end of said base member to form a cavity therebetween and having an annular weakening groove; at least one leaf spring resiliently interposed between the ogive member and the front end of said base member, and a mass of finely-divided color-producing material substantially filling the cavity, whereby on impact, said ogive member breaks at said weak region and said leaf spring snaps back to its original configuration and thereby disseminates the color material into the air to form the desired aerosol color signal.

DETAILED DESCRIPTION OF A PREFERRED EMBODIMENT

Figure 2:
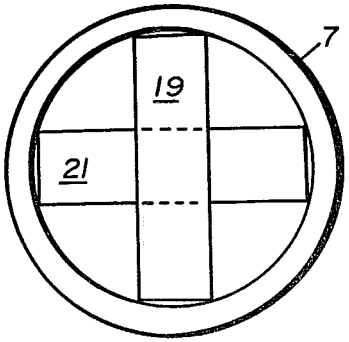
FIG. 2 is a transverse section view taken on line A—A of FIG. 1.
Figure 1:
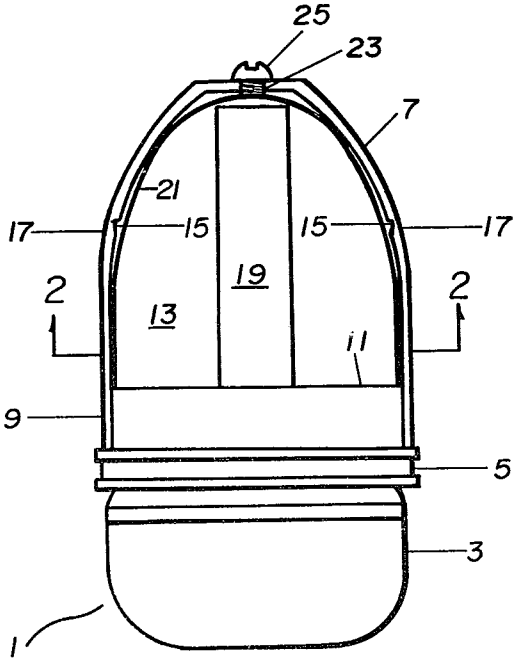
FIG. 1 is an axial section view of a training cartridge projectile incorporating the present invention.

FIGS. 1 and 2 illustrate an example of the invention incorporated in a projectile 1 adapted to be detachable mounted in the case of a training cartridge (not shown). Projectile 1 comprises a generally cylindrical base member 3 preferably of molded plastic material with an aluminum rotating band 5 imbedded as an insert in the periphery thereof, and a cup-shaped ogive member 7, also preferably of molded plastic material, having its open end 9 telescoped with the front end 11 of the base member 3 and attached to the rotating band 5, to form a color cavity 13 therein.

The ogive member 7 is formed, intermediate its ends, with an interior annular grooves 15, which leaves a thin annular weak region 17 in the wall of the ogive member and facilitates the opening of the color cavity 13 on impact. Leaf springs 19 and 21 are resiliently interposed between the ogive member 7 and the front end 11 of the base member 3. For example, leaf springs 19 and 21 may consist of normally-straight leaf springs, whose ends engage the interior wall of the ogive member 7 at its juncture with the front 11 of the base member 3. In another embodiment (not shown), the normally-straight leaf springs 19 and 21 may be positioned with the ends thereof engaging the interior wall of the ogive member 7 at the annular groove 15, or at an area forward of said annular groove, and flexed so that the center regions thereof approach or engage the front of the base member 3.

After the parts have been assembled as shown in the drawing, the color cavity 13 is substantially filled through a suitable opening, such as opening 23, closed by a screw plug 25, with a conventional signal color material, such as a finely-divided mass of HI VIZ dye. Alternately, the cup-shaped ogive member 7 may be substantially filled with a conventional signal color prior to assembly to the generally cylindrical base member 3.

For example, the projectile may be a 40 mm caliber one adapted to be fired in a 40 mm training cartridge through a rifled barrel, or other launch tube, to launch the projectile toward a desired target at ranges of several hundred meters. Preferably, the weights and shapes of the various parts of the projectile, and the cartridge propellant, are selected to mimic the performance of the standard M407 training cartridge.

In operation, when launched from a rifled barrel, the entire projectile 1 spins to assure dynamic stability in flight, and lands in the target area. When the nose of the projectile 1 impacts the target or the ground; the ogive member 7 ruptures at the weak region 17, thereby opening the color cavity 13. When the ogive member 7 opens, the leaf springs 19 and 21, which are straight when unconstrained, snap back to their straight configuration and thereby flail and disseminate the signal dye powder into the air to form an aerosol-like cloud effectively marking the location of the projectile impact zone.

It will be understood that minor variations may be made without departing from the invention. For example, the size, shape, orientation and number of the leaf spring color disseminator aids and size and position of the annular weakening groove or grooves in the ogive member can be varied in any suitable manner, as desired.

The foregoing disclosure and drawings are merely illustrative of the principles of this invention and are not to be interpreted in a limiting sense. We wish it to be understood that we do not desire to be limited to the exact details of construction shown and described, because obvious modifications will occur to a person skilled in the art.

What is claimed is:

1. A color-disseminating projectile for a training cartridge, consisting essentially of:

a generally cylindrical base member;

a cup-shaped ogive member of frangible material, closed at one end and open at the other end, having its open end attached to the front end of said base member to form a cavity therebetween, said ogive member having an annular groove intermediate its ends forming an annular weak region therein;

a mass of finely-divided color-producing material substantially filling said cavity; and a plurality of leaf spring resiliently interposed between said ogive member and the front end of said base member and substantially conforming to the interior wall of said cup shaped ogive member, for disseminating said color-producing material;

whereby, on target impact, said ogive member breaks at said weak region, and said leaf spring disseminates said material into the air, thus producing an easily-visible aerosol color signal in the region of impact.

2. A projectile as in claim 1, wherein:

said base member and said ogive member are molded of plastic material.

3. A projectile as in claim 2, wherein:

said finely-divided color-producing material is a dye.

4. A projectile as in claim 1, wherein said springs comprise a plurality of flexed, normally straight leaf springs whose ends engage the interior wall of said ogive member.

* * * * *